US010011802B2

(12) United States Patent
Narita et al.

(10) Patent No.: US 10,011,802 B2
(45) Date of Patent: Jul. 3, 2018

(54) LUBRICATING OIL COMPOSITION

(71) Applicant: IDEMITSU KOSAN CO., LTD., Chiyoda-ku (JP)

(72) Inventors: Keiichi Narita, Ichihara (JP); Atsushi Nara, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/119,568

(22) PCT Filed: Feb. 16, 2015

(86) PCT No.: PCT/JP2015/054187
§ 371 (c)(1),
(2) Date: Aug. 17, 2016

(87) PCT Pub. No.: WO2015/122525
PCT Pub. Date: Aug. 20, 2015

(65) Prior Publication Data

US 2017/0051228 A1 Feb. 23, 2017

(30) Foreign Application Priority Data

Feb. 17, 2014 (JP) ..... 2014-027765

(51) Int. Cl.
*C10M 163/00* (2006.01)
*C10M 159/22* (2006.01)
*C10M 133/06* (2006.01)

(52) U.S. Cl.
CPC .. *C10M 163/00* (2013.01); *C10M 2203/1006* (2013.01); *C10M 2203/1025* (2013.01); *C10M 2207/027* (2013.01); *C10M 2207/028* (2013.01); *C10M 2207/144* (2013.01); *C10M 2207/262* (2013.01); *C10M 2209/084* (2013.01); *C10M 2215/02* (2013.01); *C10M 2215/04* (2013.01); *C10M 2219/044* (2013.01); *C10M 2219/046* (2013.01); *C10M 2219/106* (2013.01); *C10M 2223/04* (2013.01); *C10M 2223/041* (2013.01); *C10M 2223/047* (2013.01); *C10M 2223/049* (2013.01); *C10M 2229/02* (2013.01); *C10N 2210/02* (2013.01); *C10N 2230/02* (2013.01); *C10N 2230/06* (2013.01); *C10N 2230/18* (2013.01); *C10N 2230/52* (2013.01); *C10N 2240/04* (2013.01); *C10N 2240/045* (2013.01)

(58) Field of Classification Search
CPC ..... C10M 135/10; C10M 163/00; C10M 2203/1006; C10M 2203/1025; C10M 2207/027; C10M 2207/028; C10M 2207/144; C10M 2207/162; C10M 2209/084; C10M 2215/02; C10M 2215/04; C10M 2219/044; C10M 2219/046; C10M 2219/106; C10M 2223/04; C10M 2223/041; C10M 2223/047; C10M 2223/049; C10N 2210/02; C10N 2230/02; C10N 2230/06; C10N 2230/18; C10N 2230/52; C10N 2240/04; C10N 2240/045
USPC ..... 508/399
See application file for complete search history.

(56) References Cited

U.S. PATENT DOCUMENTS

| | | | | |
|---|---|---|---|---|
| 6,451,745 | B1 * | 9/2002 | Ward | C10M 163/00 508/186 |
| 2003/0158053 | A1 * | 8/2003 | Deshimaru | C10M 129/10 508/398 |
| 2006/0111257 | A1 * | 5/2006 | Kadkhodayan | C07C 37/20 508/585 |
| 2006/0116300 | A1 | 6/2006 | Arrowsmith et al. | |
| 2007/0293406 | A1 * | 12/2007 | Henly | C10M 163/00 508/185 |
| 2012/0149619 | A1 | 6/2012 | Narita | |
| 2014/0378357 | A1 | 12/2014 | Narita et al. | |

FOREIGN PATENT DOCUMENTS

| | | | |
|---|---|---|---|
| JP | 10306292 | A * | 11/1998 |
| JP | 2001-288488 | A | 10/2001 |
| JP | 2006-152304 | A | 6/2006 |
| JP | 2009-167337 | A | 7/2009 |
| JP | 2011-12213 | A | 1/2011 |
| JP | 2011-140607 | A | 7/2011 |
| JP | 2013-189565 | A | 9/2013 |
| WO | WO 2011/037054 | A1 | 3/2011 |
| WO | WO 2013/137258 | A1 | 9/2013 |

OTHER PUBLICATIONS

English-language machine translation of JP 10-306292.*
International Search Report dated Apr. 21, 2015, in PCT/JP2015/054187 filed Feb. 16, 2015.

* cited by examiner

*Primary Examiner* — James Goloboy
(74) *Attorney, Agent, or Firm* — Oblon, McClelland, Maier & Neustadt, L.L.P.

(57) ABSTRACT

A lubricating oil composition includes: a lubricating base oil; a component (A) that is a metal detergent having a base value of less than 100 mgKOH/g; a component (B) that is a metal detergent having a base value of 100 mgKOH/g or more; a component (C) that is a tertiary amine represented by a formula (1) below, (1)

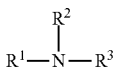

in which $R^1$ is a hydrocarbon group having 4 carbon atoms or more, and $R^2$ and $R^3$ each are a hydrocarbon group having 4 carbon atoms or less; and a component (D) that is at least one of acid phosphate and acid phosphite.

10 Claims, No Drawings

LUBRICATING OIL COMPOSITION

TECHNICAL FIELD

The present invention relates to a lubricating oil composition suitable for a continuously variable transmission.

BACKGROUND ART

Recently, a metallic belt-type continuously variable transmission and a toroidal continuously variable transmission have been developed as a transmission for an automobile and the like and have already been in practical use. A continuously variable transmission including a torque convertor provided with a lockup clutch in a starting mechanism has also been on the market. Moreover, recently, a continuously variable transmission including a mechanism (a slip control) to intentionally slip a lockup clutch has been increasingly used in order to improve fuel efficiency in a lockup speed range and to attenuate shock in engagement of the lockup clutch. On the contrary, since self-induced vibration called shudder is likely to occur depending on a lubricating oil when such a slip control is conducted, an oil for a continuously variable transmission is required to have a sustainable anti-shudder performance.

However, since a high friction coefficient between metals is required in the continuously variable transmission, it is difficult to sustain the anti-shudder performance that is in a trade-off relationship with the friction coefficient. Particularly, since a slip time of the lockup clutch in a recent continuously variable transmission is set longer than that of a conventional lockup clutch, an anti-shudder lifetime needs to be further prolonged.

Accordingly, there has been proposed a lubricating oil composition containing a base oil, (a) alkaline earth metal sulfonate or alkaline earth metal phenate, (b) an imide compound and (c) a phosphorus compound so as to increase a friction coefficient between metals and simultaneously prolong the anti-shudder lifetime (see Patent Literature 1). Moreover, for the same reason, there has been a proposed a lubricating oil composition containing: either phosphate or phosphite: and tertiary amine (see Patent Literature 2). Further, there has been proposed a lubricating oil composition containing overbased Ca sulfonate, phosphite, primary amine and tertiary amine (see Patent Literature 3).

CITATION LIST

Patent Literatures

Patent Literature 1: JP-A-2001-288488
Patent Literature 2: JP-A-2009-167337
Patent Literature 3: JP-A-2013-189565

SUMMARY OF THE INVENTION

Problems to be Solved by the Invention

However, the lubricating oil compositions disclosed in the above Patent Literatures 1 to 3 are not always sufficient in view of the anti-shudder lifetime although exhibiting a relatively high friction coefficient between metals.

An object of the invention is to provide a lubricating oil composition having a high friction coefficient between metals and a long anti-shudder lifetime.

Means for Solving the Problems

In order to solve the above problems, the Invention provides a lubricating oil composition below.

According to an aspect of the invention, a lubricating oil composition contains a lubricating base oil, a component (A) that is a metal detergent having a base value of less than 100 mgKOH/g, a component (B) that is a metal detergent having a base value of 100 mgKOH/g or more, a component (C) that is a tertiary amine represented by a formula (1) below, and a component (D) that is at least one of acid phosphate and acid phosphite.

[Formula 1]

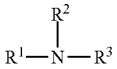

(1)

In the formula (1), $R^1$ is a hydrocarbon group having 4 carbon atoms or more, and $R^2$ and $R^3$ each are a hydrocarbon group having 4 carbon atoms or less.

According to another aspect of the invention, the lubricating oil composition according to the above aspect of the invention is used for a continuously variable transmission.

According to the lubricating oil composition in the above aspect of the invention, since the lubricating oil composition contains the lubricating base oil and specific four components, a friction coefficient between metals is high, initial anti-shudder performance is excellent and an anti-shudder lifetime is also long. Accordingly, the lubricating oil composition in the above aspect of the invention is particularly preferably applicable to a continuously variable transmission including a torque convertor provided with a lockup clutch.

DESCRIPTION OF EMBODIMENT(S)

A lubricating oil composition (hereinafter, also referred to as a "present composition") in an exemplary embodiment of the invention is provided by blending the above components (A) to (D) with a lubricating base oil. The lubricating oil composition in the exemplary embodiment will be described in detail below.

Lubricating Base Oil

A lubricating base oil usable in the exemplary embodiment may be at least one of mineral oil(s) and synthetic oil(s). Specifically, one of the mineral oil and the synthetic oil may be used alone, two or more of the mineral oils or the synthetic oils may be used in combination, or a combination of the mineral oil(s) and the synthetic oil(s) may be used.

The mineral oil and the synthetic oil are not limited to specific ones, but are preferable as long as being generally usable as a base oil for a transmission. The mineral oil and the synthetic oil preferably have a kinematic viscosity at 100 degrees C. in a range from 1 $mm^2/s$ to 50 $mM^2/s$, particularly preferably in a range from 2 $mm^2/s$ to 15 $mm^2/s$. At an excessively high kinematic viscosity, a low-temperature viscosity may be deteriorated. At an excessively low kinematic viscosity, wear at sliding parts such as a gear bearing and a clutch of the continuously variable transmission may be increased.

A pour point of the lubricating base oil, which is an index of a low-temperature fluidity, is not particularly limited, but is preferably minus 10 degrees C. or less, particularly preferably minus 15 degrees C. or less.

Further, the lubricating base oil preferably has a saturated hydrocarbon component of 90 mass % or more, a sulfur content of 0.03 mass % or less and a viscosity index of 100 or more. When the saturated hydrocarbon component is less than 90 mass %, deteriorated products may often be produced. Moreover, also when the sulfur content is more than 0.03 mass %, deteriorated products may often be produced similarly. Further, when the viscosity index is less than 100, wear at a high temperature may be increased.

Examples of the above-described mineral oil include a naphthenic mineral oil, a paraffinic mineral oil and GTL WAX. Specific examples of the mineral oil include light neutral oil, intermediate neutral oil heavy neutral oil, and bright stock.

On the other hand, examples of the synthetic oil include polybutene, a hydride thereof, poly-α-olefin (e.g., 1-octene oligomer, 1-decene oligomer), α-olefin copolymer, alkylbenzene, polyolester, diacid ester, polyoxyalkyleneglycol, polyoxyalkyleneglycolester, polyoxyalkyleneglycolether, and hindered ester and silicone oil.

Component (A) and Component (B)

The component (A) used for the present composition is a metal detergent having a base value of less than 100 mgKOH/g obtained by a perchloric acid method. The component (B) used for the present composition is a metal detergent having a base value of 100 mgKOH/a or more obtained by the perchloric acid method. By being provided by blending both of the component (A) and the component (B), the present composition can keep a high friction coefficient between metals and prolong the anti-shudder lifetime.

In view of such advantages, the base value of the component (A) is preferably 80 mgKOH/g or less, more preferably 50 mgKOH/g or less. It should be noted that the base value of the component (A) is preferably 10 mgKOH/g or more in order to keep a high friction coefficient between metals.

Similarly, in view of the advantages, the base value of the component (B) is preferably 200 mgKOH/g or more, more preferably 300 mgKOH/g or more. It should be noted that the base value of the component (B) is preferably 500 mgKOH/g or less in view of the anti-shudder lifetime.

Each of the component (A) and the component (B) is preferably at least one of metal sulfonate, metal phenate and metal salicylate. The friction coefficient between metals is increased by blending such metal compound(s). In view of the advantages, the metal compound is particularly preferably one selected from alkaline earth metal sulfonate, alkaline earth metal phenate and alkaline earth metal salicylate.

The alkaline earth metal sulfonate is exemplified by an alkaline earth metal salt of alkyl aromatic sulfonic acid obtained by sulfonating an alkyl aromatic compound preferably having a mass average molecular weight of 300 to 1500, more preferably 400 to 700. The alkaline earth metal salt thereof is particularly exemplified by a magnesium salt and a calcium salt, among which a calcium salt is preferably used.

The alkaline earth metal phenate is exemplified by an alkaline earth metal salt of alkylphenol, alkylphenol sulfide and a Mannich reaction product of alkylphenol. The alkaline earth metal salt thereof is particularly exemplified by a magnesium salt and a calcium salt, among which a calcium salt is preferably usable.

The alkaline earth metal salicylate is exemplified by an alkaline earth metal salt of alkyl salicylic acid. The alkaline earth metal salt thereof is particularly exemplified by a magnesium salt and a calcium salt, among which a calcium salt is preferably usable.

The aforementioned alkaline earth metal compounds preferably contain an alkyl group having a linear chain or a branched chain, in which the alkyl group preferably has 4 to 30 carbon atoms, more preferably 6 to 18 carbon atoms.

A content of the component (A) is preferably in a range from 0.002 mass % to 0.1 mass % of a total amount of the composition in terms of a metal content, more preferably in a range from 0.01 mass % to 0.08 mass %. When the content of the component (A) falls within this range, the advantages of the invention can be more preferably exhibited. In addition, one or a combination of two or more of the above metal compounds may be used as the component (A). Moreover, in view of the advantages of the invention, a content of the component (B) is preferably in a range from 0.01 mass % to 0.1 mass % of the total amount of the composition in terms of the metal content, more preferably in a ramie from 0.015 mass % to 0.045 mass %.

Moreover, in view of the advantages of the invention, a total content of the component (A) and the component (B) is preferably in a range from 0.012 mass % to 0.2 mass % of the total amount of the composition in terms of the metal content, more preferably in a range from 0.025 mass % to 0.125 mass %.

Component (C)

A component (C) used in the exemplary embodiment is a tertiary amine represented by a formula (1) below.

[Formula 2]

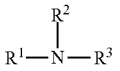

(1)

Herein, $R^1$ is a hydrocarbon group having 4 carbon atoms or more. Herein, the number of carbon atoms of $R^1$ is preferably 8 or more, more preferably 16 or more. When the number of the carbon atoms falls within this range, a friction coefficient between metals can be effectively increased. It should be noted that, in view of solubility, the number of the carbon atoms of $R^1$ is preferably 22 or less, more preferably 20 or less.

Examples of the hydrocarbon group include an alkyl group, alkenyl group, aryl group and aralkyl group. Among the hydrocarbon group, an aliphatic hydrocarbon group is preferable, among which an aliphatic hydrocarbon group in a saturated structure is particularly preferable. Accordingly, examples of $R^1$ include a hexadecyl group, heptadecyl group, octadecyl group, nonadecyl group, eicosyl group, heneicosyl group and docosyl group, among which an octadecyl group is the most preferable.

A carbon chain moiety may be in a linear structure or a branched structure, but a carbon chain moiety in a linear structure is particularly preferable.

Each of $R^2$ and $R^3$ is preferably a hydrocarbon group having 4 carbon atoms or less. Preferably, $R^2$ and $R^3$ each independently have 1 or 2 carbon atoms. Specifically, examples of each of $R^2$ and $R^3$ include a methyl group, ethyl group and vinyl group. When the number of the carbon atoms of each of $R^2$ and $R^3$ falls within this range, the anti-shudder effect can be strongly exhibited. Moreover, in view of stability, each of $R^2$ and $R^3$ is preferably a methyl group or an ethyl group rather than a vinyl group having an unsaturated structure. Respective terminal moieties of $R^2$ and $R^3$ may be bonded to each other to form a ring.

Specific examples of the component (C) include dimethylhexadecylamine, dimethyloctadecylamine, dimehtylheneicosylamine, diethyloctadecylamine and methylethyloctadecylamine. One of the tertiary amine as the component (C) in the exemplary embodiment may be used alone, or a combination of two or more thereof may be used.

In view of both the anti-shudder effect and the anti-shudder lifetime, a content of nitrogen derived from the component (C) is preferably 0.005 mass % or more of the total amount of the composition, more preferably 0.01 mass % or more, further preferably 0.02 mass % or more. However, an unnecessarily large content of the component (C) does not result in further improvement in the anti-shudder effect and the anti-shudder lifetime. Accordingly, the content of the component (C) is desirably restricted such that the content of nitrogen derived from the component (C) is 0.1 mass % or less.

Component (D)

A component (D) of the present composition is at least one of acid phosphate and acid phosphite. For instance, acid phosphate represented by a formula (2) below and acid phosphite represented by a formula (3) below are preferable. When such acid phosphate and acid phosphite are contained, the anti-shudder lifetime is considerably prolonged by an organic reaction with other blended components.

[Formula 3]

(2)

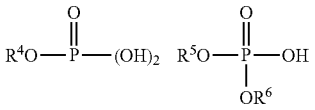

(3)

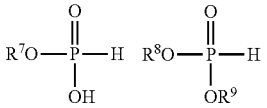

In the formulae (2) and (3), $R^4$ to $R^9$ are each a hydrocarbon group, among which a hydrocarbon group having 12 carbon atoms or less is preferable and a hydrocarbon group having 8 carbon atoms or less is more preferable. When the number of the carbon atoms of the hydrocarbon group is more than 12, the friction coefficient between metals may not be increased.

Examples of the hydrocarbon group having 12 carbon atoms or less include an alkyl group having 12 carbon atoms or less, an alkenyl group having 12 carbon atoms or less, an aryl group having 6 to 12 carbon atoms and an aralkyl group having 7 or 12 carbon atoms. The alkyl group and alkenyl group may be linear, branched or cyclic. Examples of the alkyl group and alkenyl group include a methyl group, ethyl group, n-propyl group, isopropyl group, n-butyl group, isobutyl group, sec-butyl group, tert-butyl group, various pentyl groups, various hexyl groups, various heptyl groups, various octyl groups, various nonyl groups, various decyl groups, various dodecyl groups, cyclopentyl group, cyclohexyl group, allyl group, propenyl group, various butenyl groups, various hexenyl groups, various octenyl groups, cyclopentenyl group and cyclohexenyl group.

Examples of the aryl group having 6 to 12 carbon atoms include a phenyl group, tolyl group and xylyl group. Examples of the aralkyl group having 7 to 12 carbon atoms include a benzyl group, phenethyl group, methylbenzyl group, ethylbenzyl group, propylbenzyl group, butylbenzyl group, and hexylbenzyl group.

Examples of the acid monophosphate represented by the formula (2) include monoethyl acid phosphate, mono-n-propyl acid phosphate, mono-n-butyl acid phosphate and mono-2-ethylhexyl acid phosphate. Examples of the acid diphosphate represented by the formula (2) include diethyl acid phosphate, di-n-propyl acid phosphate, di-n-butyl acid phosphate and di-2-ethylhexyl acid phosphate.

Examples of the acid monophosphite represented by the formula (3) include ethyl hydrogen phosphite, n-propyl hydrogen phosphite, n-butyl hydrogen phosphite, 2-ethylhexyl hydrogen phosphite, and di-2-ethylhexyl hydrogen phosphite.

Examples of the acid diphosphite represented by the formula (3) include dihexyl hydrogen phosphite, diheptyl hydrogen phosphite, di-n-octyl hydrogen phosphite, and di-2-ethylhexyl hydrogen phosphite. In view of the friction coefficient, among the above acid diphosphite, acid diphosphite having an alkyl group having 6 to 8 carbon atoms, particularly a branched alkyl group, is preferable, and acid diphosphite having an alkyl group having 8 carbon atoms is more preferable, As the component (D) in the exemplary embodiment, one of the aforementioned esters may be used alone or a combination of two or more thereof may be used. A content of phosphorus derived from the component (D) is preferably 0.02 mass % or more of the total amount of the lubricating oil composition, more preferably in a range from 0.03 mass % to 0.09 mass %. At the content of the component (D) of 0.02 mass % or more, the friction coefficient between metals can be increased.

The present composition preferably has the kinematic viscosity at 100 degrees C. in a range from 3.5 $mm^2/s$ to 10 $mm^2/s$, more preferably in a range from 4 $mm^2/s$ to 8.5 $mm^2/s$, further preferably in a range from 4.5 $mm^2/s$ to 7.5 $mm^2/s$. When the kinematic viscosity at 100 degrees C. of the present composition exceeds 10 $mm^2/s$, a low-temperature viscosity may be deteriorated. On the other hand, when the kinematic viscosity at 100 degrees C. of the present composition is less than 3.5 $mm^2/s$, wear at sliding parts such as a gear bearing and a clutch of the continuously variable transmission may be increased.

The present composition exhibits a high friction coefficient between metals to cause a large volume of torque transmission and also exhibits a long anti-shudder lifetime. Accordingly, the present composition is suitably applicable to various continuously variable transmissions such as a belt-type continuously variable transmission using a metallic belt (of a push-type and a chain type) and a toroidal continuously variable transmission. The present composition is particularly suitable for a continuously variable transmission including a torque convertor provided with a lockup clutch.

Herein, in the invention, the present composition provided by blending the component (A) and the component (B) means not only "a composition containing the component (A) and the component (B)" but also "a composition containing a modified substance, which is obtained by modifying at least one of the component (A) and the component (B), in place of the at least one of the component (A) and the component (B)," and "a composition containing a reactant obtained by reaction of the component (A) and the component (B)." The same applies to blending of the component (C), the component (D), various base oils and additives.

Other Additives

The lubricating oil composition in the exemplary embodiment may be added as needed with other additives such as a viscosity index improver, a pour point depressant, an antiwear agent, a friction modifier, an ashless dispersant, a rust inhibitor, a metal deactivator, an antifoaming agent and an antioxidant as long as advantages of the invention are not hampered.

Examples of the viscosity index improver include polymethacrylate, dispersed polyinethacrylate, olefin copolymer (e.g. ethylene-propylene copolymer), dispersed olefin copolymer and styrene copolymer (e.g. styrene-diene copolymer and styrene-isoprene copolymer). A content of the Viscosity index improver is approximately in a range from 0.5 mass % to 15 mass % of the total amount of the composition in view of the blending effect thereof.

An example of the pour point depressant is polymethacrylate having a mass average molecular weight of 10000 to 150000. A preferable content of the pour point depressant is approximately in a range from 0.01 mass % to 10 mass % of the total amount of the composition.

Examples of the antiwear agent include: a sulfur antiwear agent such as a thiophosphoric acid metal salt (e.g., Zn, Pb and Sb) and a thiocarbamic acid metal salt (e.g., Zn); and a phosphorus antiwear agent such as a phosphate (tricresyl phosphate). A preferable content of the antiwear agent is approximately in a range from 0.05 mass % to 5 mass % of the total amount of the composition.

Examples of the friction modifier include a polyhydric alcohol partial ester such as neopentyl glycol monolaurate, trimethyrol propanemonolaurate, glycerin monooleate (oleic acid monoglyceride). A preferable content of the friction modifier is approximately in a range from 0.05 mass % to 4 mass % of the total amount of the composition.

Examples of the ashless dispersant include succinimides, boron-containing succinimides, benzylamines, boron-containing benzylamines, succinic acid esters, and mono- or di-carboxylic acid amides respectively represented by a fatty acid or succinic acid. A preferable content of the ashless dispersant is approximately in a range from 0.1 mass % to 20 mass % of the total amount of the composition.

Examples of the rust inhibitor include a fatty acid, alkenylsuccinic acid half ester, fatty acid soap, alkyl sulfonate, fatty acid ester of polyhydric alcohol, fatty acid amide, oxidized paraffin and alkyl polyoxyethylene ether. A preferable content of the rust inhibitor is approximately in a range from 0.01 mass % to 3 mass % of the total amount of the composition.

One of the metal deactivators such as benzotriazole and thiadiazole may be used alone, or a combination of two or more thereof may be used. A preferable content of the metal deactivator is approximately in a range from 0.01 mass % to 5 mass % of the total amount of the composition.

One of the antifoaming agents such as a silicone compound and an ester compound may be used alone, or a combination of two or more thereof may be used. A preferable content of the antiwear agent is approximately in a range from 0.05 mass % to 5 mass % of the total amount of the composition.

Examples of the preferably usable antioxidant include a hindered phenol-based antioxidant, amine-based antioxidant and zinc alkyldithio phosphate (ZnDTP). As the phenol-based antioxidant, a bisphenol-based antioxidant and an ester group-containing phenol-based antioxidant are particularly preferable. As the amine-based antioxidant, a dialkyl diphenylamine-based antioxidant and a naphthylamine-based antioxidant are preferable. A preferable content of the antioxidant is approximately in a range from 0.05 mass % to 7 mass %.

EXAMPLES

Next, the invention will be described in more detail with reference to Examples and Comparatives. It should be noted that the invention is not limited to description of the examples and the like.

Examples 1 to 6, Comparatives 1 to 7

Lubricating oil compositions having compositions shown in Table 1 were prepared. Herein, a content of each of elements in the oils was measured in the following manner.

Nitrogen Content

A nitrogen content was measured according to JIS K2609.

Phosphorus and Calcium Contents

Phosphorus and calcium contents were measured according to JPI-5S-38-92.

Next, a friction coefficient between metals and a clutch anti-shudder lifetime were measured in the following manner. The results are also shown in Table 1.

Friction Coefficient between Metals: LFW-1 Test

Using a block-on-ring tester (LFW-1) according to ASTM D2174, a coefficient of friction between metals was measured. Specific test conditions are shown below.

Test Jigs

Ring: Falex S-10 Test Ring (SAE4620 Steel)

Block: Falex H-60 Test Block (SAE01 Steel)

Test Conditions

Oil Temperature: 110 degrees C.

Load: 1176 N

Slip Rate: 0.5 m/s

Trial Operation Conditions: Oil Temperature at 110 degrees C., Load at 1176 N, Slip Rate at 1 m/s, and Duration of Time for 30 minutes Clutch Anti-Shudder Lifetime The clutch anti-shudder lifetime was measured according to JASO M349-2012. Specific test conditions are shown below.

Friction Material: Cellulose disc and/or steel plate

Oil Amount: 150 mL

Face Pressure: 1 MPa

Oil Temperature: 120 degrees C.

Slip Rate: 0.9 m/s

Slip Duration of Time: 30 minutes

Quiescent Time: 1 minute

Performance Measurement: μ-V characteristics were measured every 24 hours after the start. Duration of time elapsed before reaching $d\mu/dV<0$ at 80 degrees C. was measured and defined as a clutch anti-shudder lifetime.

Trial Operation Conditions: Oil Temperature at 80 degrees C., Face Pressure of 1 MPa, Slip Rate at 0.6 m/s, and Duration of Time for 30 minutes

TABLE 1

| | | Example 1 | Example 2 | Example 3 | Example 4 | Example 5 | Example 6 | Comp. 1 | Comp. 2 | Comp. 3 | Comp. 4 | Comp. 5 | Comp. 6 | Comp. 7 |
|---|---|---|---|---|---|---|---|---|---|---|---|---|---|---|
| Blending Composition (mass %) | Base oil[1)] | rest | rest | rest | rest | rest | rest | rest | rest | rest | rest | rest | rest | rest |
| | PMA[2)] | 9.5 | 9.5 | 9.5 | 9.5 | 5.3 | 1.0 | 9.5 | 9.5 | 9.5 | 9.5 | 9.5 | 5.3 | 1.0 |
| | Low based Ca sulfonate[3)] (Component A) | 0.4 | 0.4 | 0.4 | 0.4 | 0.4 | 0.4 | — | 0.4 | 0.4 | 0.4 | 0.4 | — | — |
| | Over-based Ca sulfonate[4)] (Component B) | 0.3 | 0.2 | 0.1 | 0.3 | 0.2 | 0.2 | 0.4 | 0.3 | 0.3 | — | 0.3 | 0.2 | 0.2 |
| | Acid phosphite[5)] (Component D) | 0.25 | 0.25 | 0.25 | — | 0.25 | 0.25 | 0.25 | 0.25 | 0.25 | 0.25 | — | 0.25 | 0.25 |
| | Acid phosphate[6)] (Component D) | — | — | — | 0.25 | — | — | — | — | — | — | — | — | — |
| | Phosphorus antiwear agent[7)] | 0.3 | 0.3 | 0.3 | 0.3 | 0.3 | 0.3 | 0.3 | 0.3 | 0.3 | 0.3 | 0.3 | 0.3 | 0.3 |
| | Dimethyl-octade-cylamine (Component C) | 0.4 | 0.4 | 0.4 | 0.4 | 0.4 | 0.4 | 0.4 | — | — | — | 0.4 | 0.4 | 0.4 |
| | Tri-n-octylamine | — | — | — | — | — | — | — | 0.4 | — | 0.4 | — | — | — |
| | Isostearic acid amide | — | — | — | — | — | — | — | — | 0.4 | — | — | — | — |
| | Oleic acid monoglyc-eride | 0.25 | 0.25 | 0.25 | 0.25 | 0.25 | 0.25 | 0.25 | 0.25 | 0.25 | 0.25 | 0.25 | 0.25 | 0.25 |
| | Polybutenyl succinimide | 4.5 | 4.5 | 4.5 | 4.5 | 4.5 | 4.5 | 4.5 | 4.5 | 4.5 | 4.5 | 4.5 | 4.5 | 4.5 |
| | Sulfur antiwear agent[8)] | 0.5 | 0.5 | 0.5 | 0.5 | 0.5 | 0.5 | 0.5 | 0.5 | 0.5 | 0.5 | 0.5 | 0.5 | 0.5 |
| | Copper deactivator[9)] | 0.05 | 0.05 | 0.05 | 0.05 | 0.05 | 0.05 | 0.05 | 0.05 | 0.05 | 0.05 | 0.05 | 0.05 | 0.05 |
| | Antifoaming agent[10)] | 0.2 | 0.2 | 0.2 | 0.2 | 0.2 | 0.2 | 0.2 | 0.2 | 0.2 | 0.2 | 0.2 | 0.2 | 0.2 |
| Property | Kinematic viscosity at 100° C. ($mm^2/s$) | 7.1 | 7.1 | 7.1 | 7.1 | 6.0 | 5.0 | 7.1 | 7.1 | 7.1 | 7.1 | 7.1 | 6.0 | 5.0 |
| Elements in oil (mass %) | Phosphorus concen-tration | 0.05 | 0.05 | 0.05 | 0.05 | 0.05 | 0.05 | 0.05 | 0.05 | 0.05 | 0.05 | 0.02 | 0.05 | 0.05 |
| | Calcium concen-tration | 0.05 | 0.04 | 0.03 | 0.05 | 0.04 | 0.04 | 0.05 | 0.05 | 0.05 | 0.01 | 0.05 | 0.04 | 0.04 |
| Evaluation Results | LFW-1 Friction coefficient between metals | 0.122 | 0.121 | 0.121 | 0.123 | 0.120 | 0.120 | 0.121 | 0.120 | 0.104 | 0.108 | 0.108 | 0.121 | 0.120 |
| | Clutch anti-shudder lifetime (hrs) | 504 | 528 | 552 | 480 | 504 | 480 | 196 | 120 | 192 | 220 | 360 | 192 | 168 |

[1)]Base oil: Hydrogenated modified mineral oil (a kinematic viscosity at 100 degrees C. of 4.4 $mm^2/s$, a viscosity index of 127)
[2)]PMA: Polymethacrylate having a mass average molecular weight of 30,000
[3)]Low based Ca sulfonate (Component A): base value of 20 mgKOH/g
[4)]High based Ca sulfonate (Component B): base value of 350 mgKOH/g
[5)]Acid phosphite (Component D): 2-ethylhexyl hydrogen phosphite
[6)]Acid phosphate (Component D): mono-2-ethylhexyl acid phosphate
[7)]Phosphorus antiwear agent: tricresyl phosphate
[8)]Sulfur antiwear agent: tridecyl dithiopropionate
[9)]Copper deactivator: thiadiazole compound
[10)]Antifoaming agent: silicone compound Evaluation Results The results of Examples 1 to 6 in Table 1 show that the lubricating oil compositions of the invention provided by blending all of the components (A) to (D) with the base oil exhibit a sufficiently high friction coefficient between metals and a sufficiently long clutch anti-shudder lifetime. Accordingly, the lubricating oil compositions of the invention are preferably applicable to a continuously variable transmission. Particularly, it is understood that the lubricating oil compositions of the invention are outstandingly excellent in application to a continuously variable transmission provided with a lockup clutch whose slip time is set longer than that of a conventional one.

On the other hand, since the lubricating oil compositions of Comparatives 1 to 7 do not contain one of the components (A) to (D) of the invention, the friction coefficient between metals and the anti-shudder lifetime cannot be satisfied simultaneously.

The invention claimed is:

1. A lubricating oil composition comprising:

a base oil;

a component (A) that is calcium sulfonate having a base value of from 10 mgKOH to less than 100 mgKOH/g;

a component (B) that is calcium sulfonate having a base value of 100 mgKOH/g to 500 mgKOH/g;

wherein a total content of the component (A) and the component (B) is in a range from 0.025 mass % to 0.2 mass % of a total amount of the lubricating oil composition based on a calcium content;

wherein a mass ratio of the component (A) and the component (B) is in a range of from 4:3 to 4:1 based on the total mass of the component (A) and the total mass of the component (B);

wherein the component (B) is present in an amount of 0.015 to 0.045 mass % based on a calcium content;

a component (C) that is a tertiary amine represented by a formula (1) below, (1)

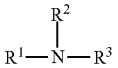

where: $R^1$ is a hydrocarbon group having 16-22 carbon atoms, and $R^2$ and $R^3$ each are a hydrocarbon group having 4 carbon atoms or less;

wherein the component (C) is present in an amount of 0.01 to 0.1 mass % based on an amount of nitrogen; and a component (D) that is at least one selected from the group consisting of acid phosphate and acid phosphite;

wherein the component (D) is present in an amount of 0.02 mass % or more based on an amount of phosphorus, and wherein the lubricating oil composition has a coefficient of friction between metals measured using a tester according to ASTM D2174 of from 0.120 to 0.123, and a clutch anti-shudder lifetime measured according to JASO M349-2012 of from 480 to 552 hours.

2. The lubricating oil composition according to claim 1, wherein the component (D) is an acid phosphite.

3. The lubricating oil composition according to claim 1, wherein the lubricating oil composition is used for a continuously variable transmission.

4. The lubricating oil composition according to claim 1, wherein the amount of the component (A) is from 0.01 to 0.08 mass % based on the calcium content.

5. The lubricating oil composition according to claim 1, wherein $R^2$ and $R^3$ have 1 or 2 carbon atoms and $R^1$ has from 16 to 20 carbon atoms.

6. The lubricating oil composition according to claim 1, wherein the amount of the component (D) is from 0.02 to 0.09 mass % based on the amount of phosphorous phosphorus.

7. The lubricating oil composition according to claim 6, wherein the acid phosphate and the acid phosphite have the following structures (2) and (3):

(2)

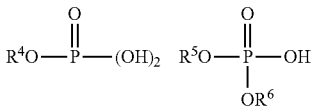

(3)

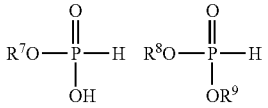

wherein $R^4$ to $R^9$ are hydrocarbon groups having 12 carbon atoms or less.

8. The lubricating oil composition according to claim 1, wherein the total content of the components (A) and (B) is from 0.025 to 0.09 mass % based on the calcium content.

9. The lubricating oil composition according to claim 1, wherein the component (A) has a base value of from 10 mgKOH/g to 50 mgKOH/g; and the component (B) has a base value of 300 mgKOH/g to 500 mgKOH/g.

10. The lubricating oil composition according to claim 1, wherein the component (C) is selected from the group consisting of dimethylhexadecylamine, dimethyloctadecylamine, dimethylheneicosylamine, diethyloctadecylamine, methylethyloctadecylamine and combinations thereof.

* * * * *